US005946861A

United States Patent [19]

Krist et al.

[11] Patent Number: 5,946,861

[45] Date of Patent: Sep. 7, 1999

[54] APPARATUS FOR THE FIXATION OF THE RIMS OF BATH AND SHOWER TUBS RELATIVE TO A WALL

[75] Inventors: Dieter Krist, Winnenden; Bernd Hanel, Fellbach, both of Germany

[73] Assignee: E. Missel GmbH, Stuttgart, Germany

[21] Appl. No.: 08/890,255

[22] Filed: Jul. 9, 1997

[30] Foreign Application Priority Data

Jul. 10, 1996 [DE] Germany ..... 196 27 836

[51] Int. Cl.[6] ..... A47K 3/16

[52] U.S. Cl. ..... 52/35; 52/34; 4/592; 4/595; 4/584

[58] Field of Search ..... 52/35, 741, 34; 4/584, 595, 592

[56] References Cited

U.S. PATENT DOCUMENTS 2,102,082 12/1937 Lucke .

FOREIGN PATENT DOCUMENTS 0 513 720 A1 11/1992 European Pat. Off. .
0 635 233 A2 1/1995 European Pat. Off. .
0 723 757 A1 7/1996 European Pat. Off. .
1399294 4/1965 France .
24 19 253 10/1975 Germany .
37 36 134 C1 9/1988 Germany .
41 26 383 C2 11/1994 Germany .
43 24 133 A1 1/1995 Germany .
2 096 060 10/1982 United Kingdom .

*Primary Examiner*—Christopher Kent
*Assistant Examiner*—Yvonne Horten-Richardson
*Attorney, Agent, or Firm*—Townsend and Townsend and Crew LLP

[57] ABSTRACT

Apparatus for the fixation and support of the rims of bath and shower tubs relative to a wall of a construction in a manner decoupled from structure-borne noise. The apparatus includes a fixing element secured to the wall and has a support surface for a rim of a tub. A fixing screw is screwed into the fixing element and a first insulating material is arranged between the wall and the tub rim. A second insulating material is arranged between the support surface and the tub rim while a third insulating material is secured to an end of the fixing screw and contacts against the inner side of the tub rim.

17 Claims, 2 Drawing Sheets

APPARATUS FOR THE FIXATION OF THE RIMS OF BATH AND SHOWER TUBS RELATIVE TO A WALL

FIELD OF THE INVENTION

The invention relates to an apparatus for the fixation of the rims of bath and shower tubs relative to a wall of a construction in a manner decoupled with respect to structure-borne noise.

BACKGROUND OF THE INVENTION

Such apparatus of known design, which are also termed "tub clamping fittings" do indeed ensure a reliable fixation of the tub rims, however, they only satisfy the requirement of decoupling the particular tub relative to the building with respect to structure-borne noise in a very inadequate manner and at relatively high cost, i.e. with a complicated construction.

OBJECT OF THE INVENTION

It is the object of the invention to design an apparatus of the initially named kind, while ensuring a simple layout and non-problematic handling during installation, so that the existing requirements for simple manufacture and problem-free decoupling from structure-borne noise are satisfied.

BRIEF DESCRIPTION OF THE INVENTION

This object is satisfied in an apparatus of the initially named kind by a fixing element securable to the wall and having a support surface for the rim of the tub, a fixing screw, which can be screwed into the fixing element, with the front end of the fixing screw serving for contact against the inner side of the tub rim, a first insulating material which is arranged between the wall and the tub rim, a second insulating material which is arranged between the support surface and the tub rim and a third insulating material which is secured to the end of the fixing screw.

It is particularly important that a fixing element securable relative to the wall is provided and has a support surface for the tub rim. A fixing screw can be screwed into this fixing element, with its front end serving for contact against the inner side of the tub rim. Four acoustic decoupling insulating materials are furthermore provided at three points of the apparatus, namely between the wall and the tub rim, between the support surface of the fixing element and the tub rim and between the end of the fixing screw and the inner side of the tub rim. As the fixing screw is screwed directly into the fixing element and presses via the insulating material directly onto the tub rim, a very simple but efficient design is provided which makes do with a total of only two components (fixing element and fixing screw).

Thus, the fixing element can have a contact limb which is intended for contact against the wall and also a holding limb which is arranged displaced relative thereto, but extends essentially parallel thereto, and into which the fixing screw is screwed. In this way, a very simply designed fixing element is provided which can be manufactured at favorable cost.

If the fixing element is made essentially S-shaped in cross-section (or also double L-shaped) and if the contact limb is connected in one piece with the holding limb via a horizontal central web, then, when the fixing element is installed, an intermediate space is provided between the wall and the holding limb into which the tub rim can be inserted. In this respect, the central web serves as a support surface for the tub rim, with the second insulating material being provided between this support surface and the tub rim. A further advantage of a fixing element formed in this way is that the tub can be secured against displacement parallel to the wall after it has been "hung into" the fixing element. With a one-sided wall attachment of bath and shower tubs in particular, installation situations can arise (when the other three tub sides have not yet been built under or supported on a wall) in which a displacement of the tub parallel to the walls to be erected is possible. Through the fixing element designed in accordance with the invention the tub can, however, also be shifted without problem in the fixing element into the prescribed position, provided the fixing screws have not been fully tightened.

In accordance with a further design of the invention, the fixing screw can be screwed into the fixing element via a thread, preferably in the holding limb. This embodiment is again advantageous in as much as only a single screw (and no counter-nut) is required and thus no holding clips or the like must be used which would otherwise have to be additionally manufactured and installed.

In accordance with a further advantageous embodiment of the invention. The fixing screw can be tightened without tools and is preferably a knurled head screw or a diagonally knurled screw, a machine-knob screw or the like. Through this embodiment the advantage arises, that no tool is necessary for the fastening of the fixing screw. On the other hand, through the use of such screws it is almost entirely precluded that the fixing screw will be tightened too hard such as can be the case when using tools. Thus, these screws, which can only be moved by hand, ensure that the tub is only clamped against the wall with a relatively low force, which ensures that no acoustic coupling is produced between the tub and the wall or between the tub and the fixing element by excessive tightening. High clamping forces can admittedly be achieved with customary clamping fittings, however, effects which result in the decoupling of structure-borne noise are, as a rule, completely precluded or destroyed by high clamping forces. Such high clamping forces are, however, also not necessary, since, after the installation of the tub, a substructure or support wall is built facing the room at least at one side which in any event guarantees high stability and reliable mounting.

The fixing screw can be arranged above the second insulating material which results in a compact design. The first and the second insulating materials can also be connected together in one piece. The holding limb of the fixing element can in addition be provided at one side or at both sides with additional insulating material, for example in the form of a soft coating. In this way an additional acoustic decoupling is achieved between the knurled screw and the fixing element on the one hand and also ensured between the tub rim and the fixing element on the other hand.

In accordance with a further development of the invention the second insulating material can be provided at its upper side with a self-adhesive tape. In this way it is ensured that the tub, after being fixed in position, no longer slides or shifts in the fixing element because the tub rim is adhesively bonded to the second insulating material after it has been hung into the fixing element and the second insulating material is likewise fixed to the fixing element.

It is advantageous when the third insulating material, which is secured to the end of the fixing screw, is a soft resilient element, for example of rubber, elastomer or foam material.

An element of this kind can have the shape of a union nut, a disk or the like and be pushed onto or bonded onto the end of the fixing screw or fixed to the end in a suitable manner, so that no structure-borne noise can be transported from the tub to the fixing screw and from there via the rail to the wall. Customary, soft resilient insulating materials, cushion layers or acoustic protection sections of polyethylene, rubber, elastomer or the like can be used as the first and second insulating materials.

The fixing element can be of rail-like design and be provided with at least four elongate holes for the attachment to the wall, with the holes being arranged displaced by 90° relative to one another. These elongate holes can be later punched, bored, or milled into the rail or are already present in the rail by being preformed therein. In this way, the rail can be secured by means of wall screws to the wall at at least two points. As a result of the number of attachment holes, the use of further fixing screws is also possible with perforated brick walls or crumbling walls. On the other hand, the rail can be easily adjusted in the horizontal and vertical direction.

In accordance with a further design, the fixing element can be of rail-like design, with two fixing screws being respectively arranged at the outer lip of the rail. A rail of this kind, which can, for example, be 600 mm long for shower tubs and, for example 1200 mm long for bath tubs, can be used without problem during the installation of the tub, since the two fixing screws to the left and right sides of the tub can be reached and actuated by hand. In this respect the fixing screws can be arranged with a spacing of ca. 1 cm to 10 cm from the outer limit of the rail.

The apparatus of the invention can also be used for the two and three sided wall connection of bath and shower tubs, with a rail-like fixing element first being secured to the wall and with the tub subsequently being supported by support feet until it has been built under or supported by a substructure. A further fixing element can be arranged at the second wall which is available and permits easy locking. For this, the further fixing element does not have to be of rail-like design, but can have only a single fixing screw and consist of a relatively short rail piece of, for example 1 to 10 cm long.

For a short rail piece of this kind, one vertically arranged elongate hole is sufficient in order to bring the tub into a horizontal position, to hold it and to secure it against displacement or shifting. It is basically possible to dispense with a long support foot when using a second fixing element.

BRIEF LISTING OF THE DRAWINGS

DESCRIPTION OF PREFERRED EMBODIMENTS

Figure 1:
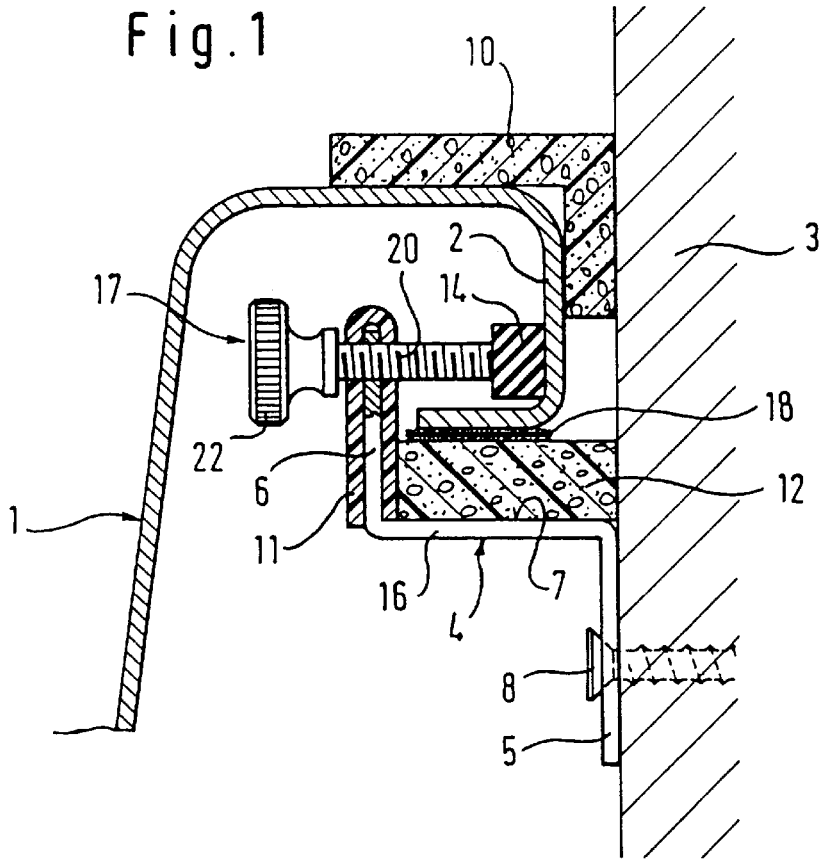
FIG. 1 is a cross-section through a tub rim with a side view of the apparatus of the invention.

FIG. 1 shows the fixing of a tub 1 with a tub rim 2 to a wall 3. As can be seen the tub rim is of substantially U-shaped design and consists of a first horizontal section which adjoins the actual body of the tub, a vertical section which follows it and which extends parallel to the wall 3 and also of a third section which again extends horizontally and is bent inwardly.

In other tub designs the third horizontal section is omitted and the rim of the tub is L-shaped. The support and fixation of the tub rim using the fixing element are, however, fundamentally the same as the functions which have already been described.

The apparatus of the invention has a fixing element 4 for the fixing of the tub rim in a manner decoupled with respect to structure-borne noise. The fixing element 4 has a contact limb 5 extending parallel to the wall 3, a holding limb arranged displaced relative thereto, but likewise parallel to the wall 3 and parallel to the contact limb 5 as well as a horizontal central web 16 which connects the contact limb 5 with the holding limb 6 in one piece. Thus an angle of 90° is formed between the central web 16 and each of the two limbs, so that in cross-section the shape of a stylized S results.

The fixing element 4 is secured by screws 8 to the wall 3, with the screws 8 being led through bores in the contact limb 5.

The apparatus of the invention furthermore includes a fixing screw 17 which is screwed via a thread 20 into the holding limb 6. The fixing screw has a knurled head 22 at its front end and can thus be tensioned by hand. A soft resilient element 14 of rubber is secured to the fixing screw at the opposite end of the fixing screw 17 as insulating material and presses against the inner side of the vertically extending tub rim or lip 2.

Figure 3:
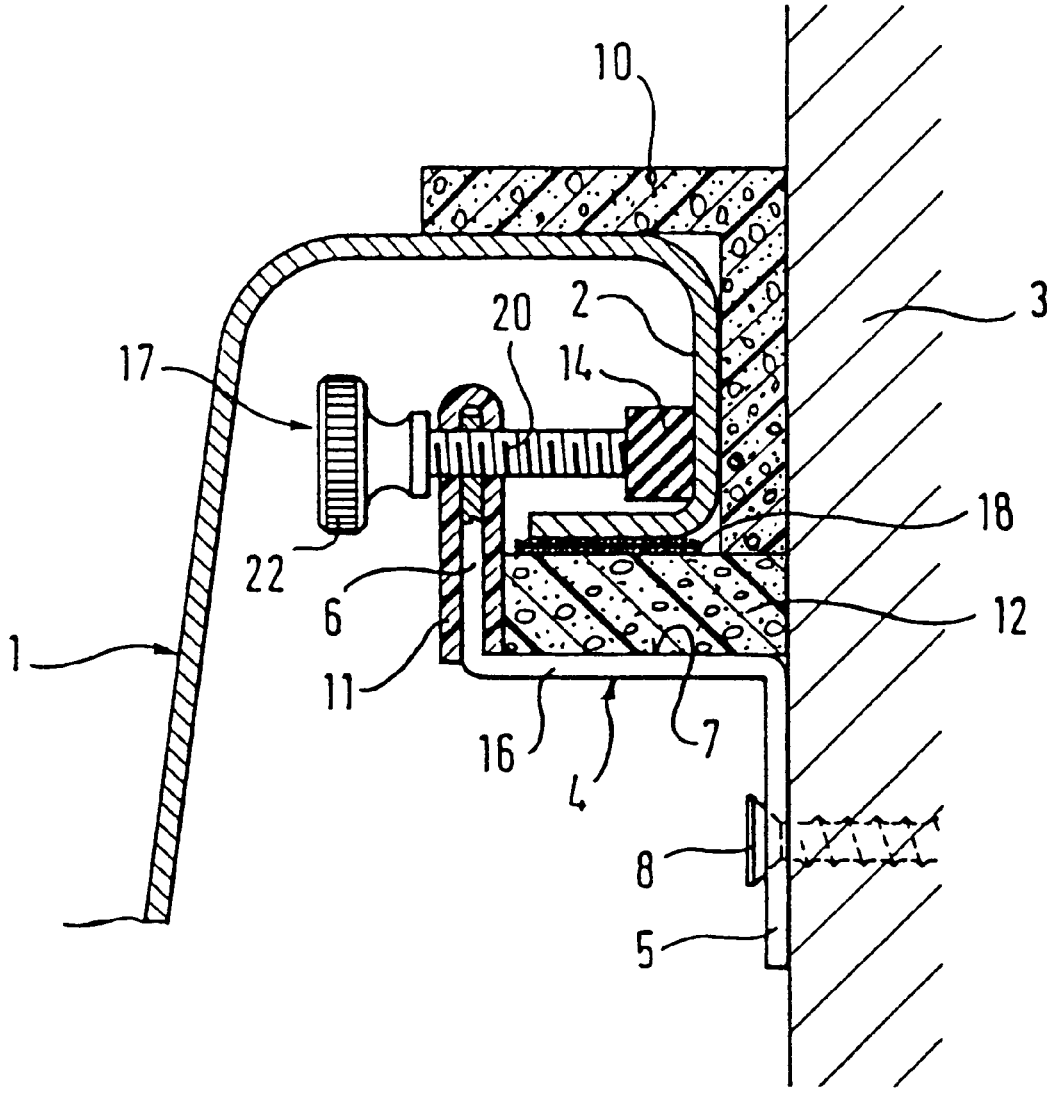
FIG. 3 is a cross-section through a tub rim with a side view of the apparatus of an alternative embodiment of the invention.

Two further insulating materials are provided for acoustic decoupling between the tub 1 and the wall 3, namely an acoustic protection section 10 at the wall side which is formed with an L-shaped cross-section of which one limb fills out the space between the tub rim 2 and the wall 3, and also a cushion layer 12 which is located between a support surface 7 of a central web 16 of the fixing element 4 and the tub rim 2. The cushion layer 12 thereby fills out the intermediate space between the wall 3 and the holding limb 6. The protection section 10 and the cushion layer 12 can be connected together to form one piece, e.g. by extending the leg of section 10 downwardly along the space between tub rim 2 and wall 3. Such an alternative embodiment is illustrated in FIG. 3.

As FIG. 1 shows, the fixing screw 17 is arranged above the cushion layer 12 and is located at the upper side of the holding limb 6. In this way the cushion layer 12 can be made relatively thick, with the tub rim 2 nevertheless being arranged between the fixing screw 17 and the cushion layer 12. The holding limb 6 is provided with a covering 11 of insulating material which, on the one hand, acoustically decouples the fixing screw 17 and, on the other hand, ensures that no sound is transmitted from the end face of the tub rim 2 to the wall 3 via the fixing element 4 if the end face of the tub rim should butt against the fixing element. Moreover, an additional decoupling with respect to the cushion layer 12 is also provided.

A double-sided self-adhesive tape 18 is provided at the upper side of the cushion layer 12 which serves for the additional fixation of the tub and assists the fixing screw to prevent displacement or shifting once the tub has been adjusted.

Figure 2:
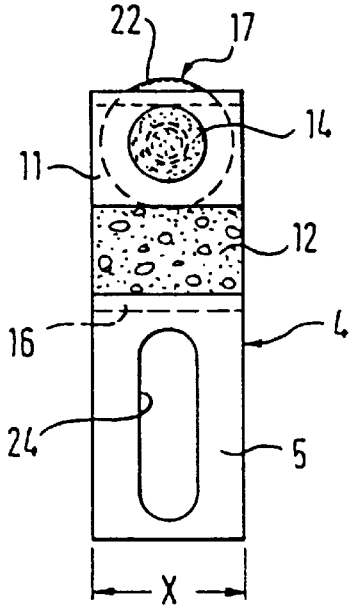
FIG. 2 is a wall-side plan view of an apparatus in accordance with the invention which is formed as a short rail piece.

FIG. 2 shows a plan view from the rear of a fixing element 4 provided with only one fixing bore 24, which is formed as an elongate hole and serves for the attachment of the fixing element to the wall 3.

However, the fixing element 4 can also have a substantially greater length. In this case, several elongate holes are provided for the attachment to the wall 3 and are arranged displaced by 90° to each other. In this case, two fixing screws 17 are so arranged at the lips of the fixing element that they can easily be tightened from the outside when the tub has been set in place. The illustrated dimension X can thus vary between ca. 1 cm for a very short angled piece and ca. 1 m for an angled rail.

What is claimed is:

1. Apparatus for the fixation and support of the rims of bath and shower tubs relative to a wall of a construction in a manner decoupled from structure-borne noise, the apparatus comprising:

a fixing element securable to the wall and having a support surface for a rim of the tub, a fixing screw that is screwed into the fixing element;

a first insulating material that is arranged between the wall and the tub rim;

a second insulating material that is arranged between the support surface and the tub rim; and a third insulating material that is secured to an end of the fixing screw, and that contacts against an inner side of the tub trim between the end of the fixing screw and the inner side of the tub rim.

2. Apparatus in accordance with claim 1, wherein the fixing element has a contact limb for contact against the wall and a holding limb arranged displaced relative to the contact limb and extending at least substantially parallel thereto.

3. Apparatus in accordance with claim 2, wherein the fixing element is substantially S-shaped in cross-section.

4. Apparatus in accordance with claim 3, wherein the contact limb is connected in one piece with the holding limb via a horizontal central web.

5. Apparatus in accordance with claim 1, wherein the fixing screw is screwed into the fixing element via a thread.

6. Apparatus in accordance with claim 2, wherein the fixing screw is screwed via a thread into the holding limb of the fixing element.

7. Apparatus in accordance with claim 1, wherein the fixing screw is tightened without tools.

8. Apparatus in accordance with claim 7, wherein the fixing screw is a knurled head screw.

9. Apparatus in accordance with claim 1, wherein the fixing screw is arranged above the second insulating material.

10. Apparatus in accordance with claim 1, wherein the first and second insulating materials are connected together to form one piece.

11. Apparatus in accordance with claim 2, wherein the holding limb is provided with additional insulating material.

12. Apparatus in accordance with claim 11, wherein the additional insulating material is provided on both sides of the holding limb.

13. Apparatus in accordance with claim 2, wherein the second insulating material fills out an intermediate space between the wall and the holding limb.

14. Apparatus in accordance with claim 1, wherein the second insulating material is provided with a self-adhesive tape at its upper side.

15. Apparatus in accordance with claim 1, wherein the third insulating material is a soft resilient element.

16. Apparatus in accordance with claim 1, wherein the fixing element comprises a rail provided with at least four elongate holes for the attachment to the wall, with the elongate holes being displaced 90° to one another.

17. Apparatus in accordance with claim 1, wherein the fixing element comprises a rail provided with first and second fixing screws which are arranged at an outer margin of the rail.

* * * * *